United States Patent [19]

Stenemann

[11] 4,030,958

[45] June 21, 1977

[54] PAVEMENT-STRIPING APPARATUS

[75] Inventor: Heinrich F. Stenemann, Woodbury, Minn.

[73] Assignee: Minnesota Mining and Manufacturing Company, St. Paul, Minn.

[22] Filed: Aug. 9, 1976

[21] Appl. No.: 712,679

[52] U.S. Cl. ..... 156/350; 156/71; 156/366; 156/522; 156/523; 156/574; 404/94

[51] Int. Cl.[2] ..... B26D 5/00; G05G 15/00

[58] Field of Search ..... 156/350, 353–355, 156/361, 366, 522, 523; 404/93, 94, 84; 186/71, 527, 530, 367, 378, 522, 524

[56] References Cited

UNITED STATES PATENTS

| | | | |
|---|---|---|---|
| 2,248,744 | 7/1941 | Cohen | 156/353 |
| 2,776,068 | 1/1957 | Johnson | 156/353 |
| 3,007,838 | 11/1961 | Eigenmann | 156/526 |
| 3,155,564 | 11/1964 | Eigenmann | 156/575 |
| 3,235,436 | 2/1966 | Eigenmann | 156/523 |
| 3,350,256 | 10/1967 | Eckman et al. | 156/523 |
| 3,477,352 | 11/1969 | Harding | 404/94 |
| 3,886,011 | 5/1975 | Eigenmann | 156/71 |
| 3,964,835 | 6/1976 | Eigenmann | 259/8 X |
| 3,984,276 | 10/1976 | Stuart | 156/366 |

*Primary Examiner*—David A. Simmons
*Attorney, Agent, or Firm*—Cruzan Alexander; Donald M. Sell; Roger R. Tamte

[57] ABSTRACT

Pavement-striping apparatus is disclosed for automatically feeding tape from a roll and pressing it into contact with a paved surface in continuous stripes or intermittent stripes of variable spacing, width, and length.

12 Claims, 6 Drawing Figures

PAVEMENT-STRIPING APPARATUS

INTRODUCTION

To make pavement-marking tapes competitive with paints as a principal traffic control marking on a street or highway, there must be an economic and reliable procedure for applying the tape to the roadway. Despite the fact that many types of apparatus have been proposed in the past for applying tape to a paved surface, none of them satisfies the needed requirements. Two kinds of devices that attempt to deal with some of the needs are a first type taught in Eckman, U.S. Pat. No. 3,350,256 and a second type taught in a series of Eigenmann patents, i.e. U.S. Pats. Nos. 3,007,838; 3,155,564; and 3,235,436. However, the first of these types is manually operated to apply tape, and is not truly adapted to automatic down-the-road striping (Eigenmann, U.S. Pat. No. 3,886,011, cursorily describes a variation of this first type of apparatus, which also is not adapted to smooth automatic striping). And the second type is a complex and expensive structure which cuts lengths of tape internally in the apparatus and then conveys those lengths to the roadway.

The present invention provides inexpensive reliable apparatus for automatically applying pavement-marking tape, either in continuous stripes or in intermittent stripes of variable length, width, and spacing. This apparatus makes possible down-the-road striping operations that are simple, reliable, and rapid. Briefly, the new apparatus comprises:

a. a frame;

b. a support on the frame for rotatably supporting a roll of said tape;

c. an application head for applying tape to the paved surface comprising:

i. an engagement roller that is movable to and away from the paved surface;

ii. keeper means for holding tape adjacent the engagement roller such that movement of the engagement roller to the paved surface presses the tape into engagement with the paved surface;

iii. a pressure roller for pressing the tape after it has been engaged against the paved surface by the engagement roller; and iv. cutter means for cutting tape that extends between the engagement roller and pressure roller after the engagement roller has been moved away from the paved surface;

d. accumulator means located between the roll of tape and the application head and comprising a set of guides over which the tape is threaded, said guides being movable against an adjustable biasing pressure from a first position which provides a serpentine path for tape traveling from the roll of tape to the application head to at least a second position which provides a more direct path for the tape;

e. timer means for initiating movement of said engagement roller to and away from the paved surface; and f. tape-starting means actuatable by said timer means prior to movement of said engagement roller to the paved surface and comprising means for relaxing the biasing pressure on the accumulator so as to allow easier movement of the accumulator from the first position to the second position.

Tape extends in a continuous length through the apparatus from the supply roll to the engagement roller, and the tape is under tension over that length. Yet tape application proceeds smoothly, without jerking or tearing of tape. The tape is held under positive control throughout the operation, such that straight lines and at desired spacing, are reliably adhered to the paved surface, and the stripes can be applied rapidly in an automatic down-the-road striping operation.

DETAILED DESCRIPTION

Figures 1, 6:
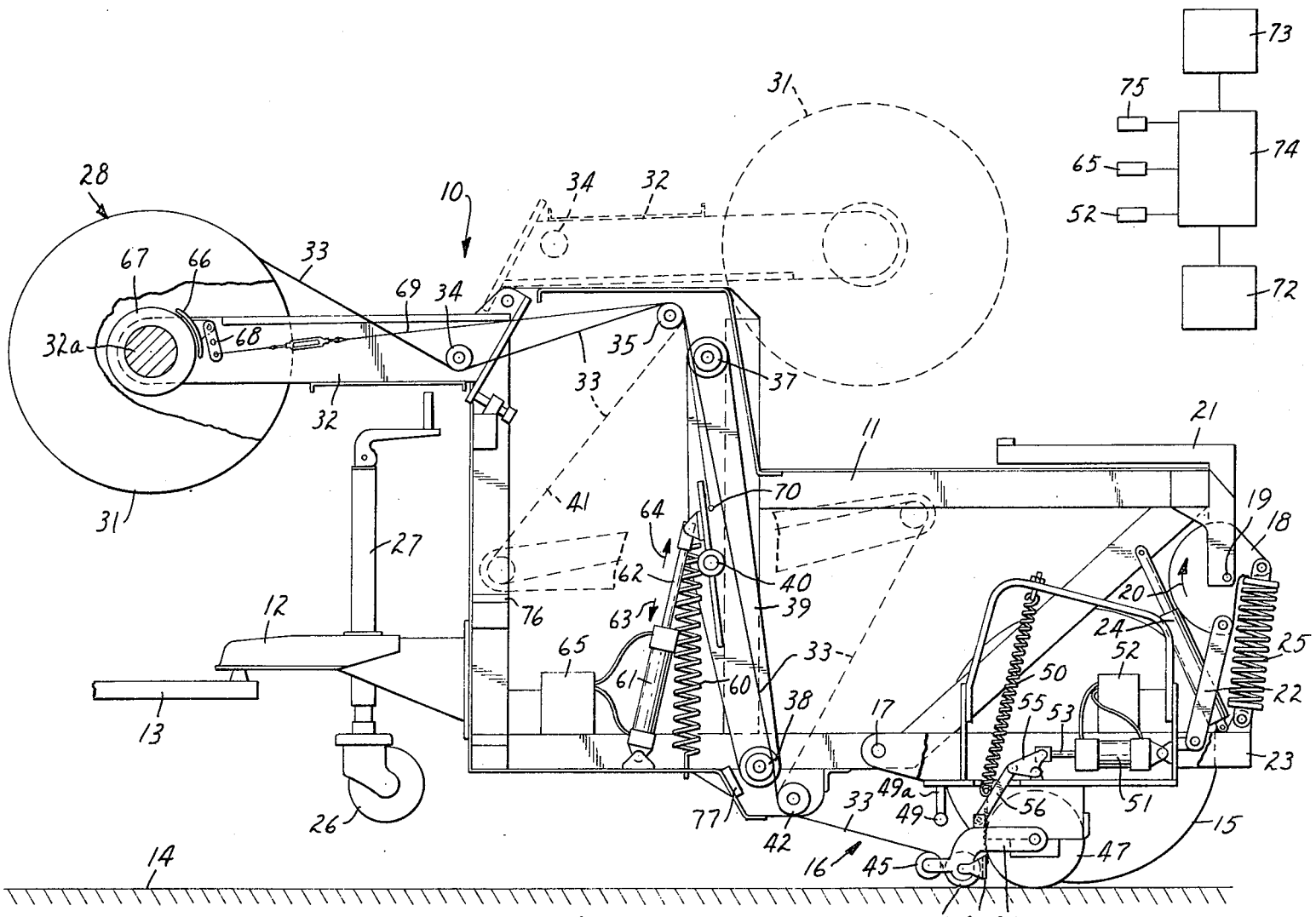
FIG. 1 is a side elevation view of representative pavement-striping apparatus of the invention.
FIG. 6 is a schematic diagram of electric circuitry for operating the illustrated pavement-striping apparatus.

The illustrative pavement-striping apparatus 10, shown in FIG. 1 comprises a frame 11 having an arm 12 for connecting the apparatus to the hitch 13 of a truck so as to pull the apparatus along a paved surface 14. The rear of the apparatus 10 can be alternatively supported by wheels 15 or, as shown in FIG. 1, by an application head 16 which is pivotably attached to the frame at pivot point 17. The application head 16 can be raised from the position shown in FIG. 1 by rotation of a sector plate 18 about its pivot point 19 in the direction of arrow 20 by manual pressure on a lever arm 21, which movement is transmitted through a link 22 to the application head. The axle (not illustrated) for the wheels 15 is supported by a member 23 pivotably attached to the frame 11 at this point 17 and connected to the frame through shock absorbers 24. Pivoting of the sector plate 18 also applies compression on a spring 25 which further cushions the connection between the member 23 and the rest of the frame 11.

A front wheel 26 is supported on a threaded post 27 which can be turned to engage the wheel against a roadway for storage or other kinds of handling of the striping apparatus.

Figure 3:
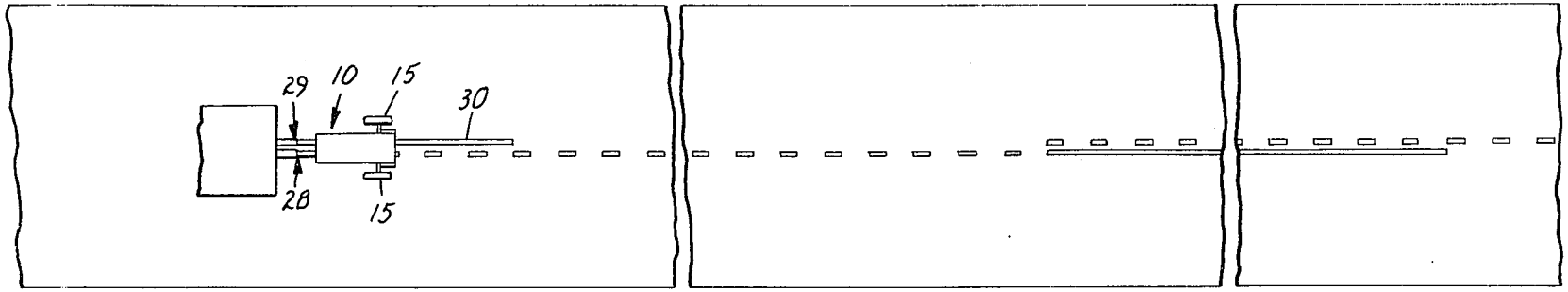
FIG. 3 is a schematic top view of a roadway being striped with apparatus as shown in FIG. 1.
Figure 2:
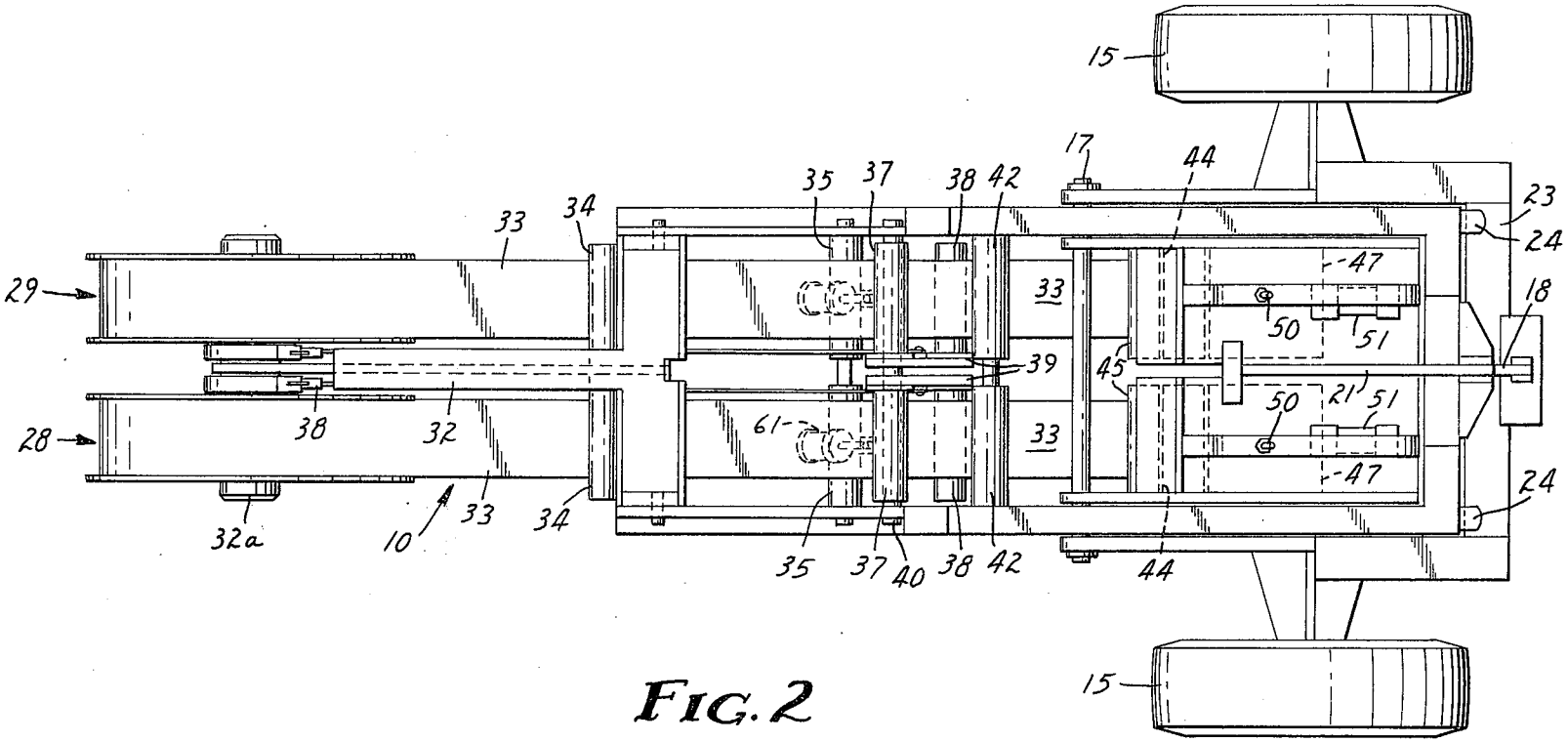
FIG. 2 is a top view of the apparatus shown in FIG. 1.

As seen best in FIGS. 2 and 3, the illustrative pavement-striping apparatus 10 includes two separate tape-applying systems 28 and 29 so as to apply a double stripe of tape. Only the system 28 will be described, but it should be understood that the system 29 is an essential duplicate of the described system 28. As shown in FIG. 3 each of the separate systems 28 and 29 can be operated independently of the other to apply stripes 30, which can be continuous or intermittent, or no stripes. By use of two such separate striping systems the needed stripes for a center area of a highway can be provided. Either of the striping systems can be used to apply the center dividing line and either can be used to apply a continuous stripe that signals a "no passing"zone.

Each striping system includes a reel rotatably mounted on an arm 32 and adapted to support a roll of tape 33 that is to be applied. The arm 32 may be pivoted to the dotted-line position shown in FIG. 1 for storage or during transport of the striping apparatus between striping jobs. The hub **32*a* of the arm 32 has a length that will accommodate reels of different width or that allows reels to be positioned at different locations along the hub, whereby tapes of different width may be applied or whereby the two tapes applied by the two systems 28 and 29** may be spaced apart different amounts. Other rollers over which tape is passed in the apparatus have a similar length. Yet because of the tension maintained on the tape as it moves through the apparatus, a straight stripe is applied.

Tape 33 unwound from the reel 31 travels over two idler rollers 34 and 35 and then through an accumulator, which comprises two guide rollers 37 an 38 that serve as path formers and are mounted rotatably on a bar 39 that is rotatably attached to the frame 11 at 40. Immediately prior to application of a stripe of tape, the bar 39 is in the dotted line position shown in FIG. 1 so as to provide a serpentine path 41 for the tape. From the accumulator rollers the tape travels to an idler roller 42 and from there to the application head 16.

Figure 4:
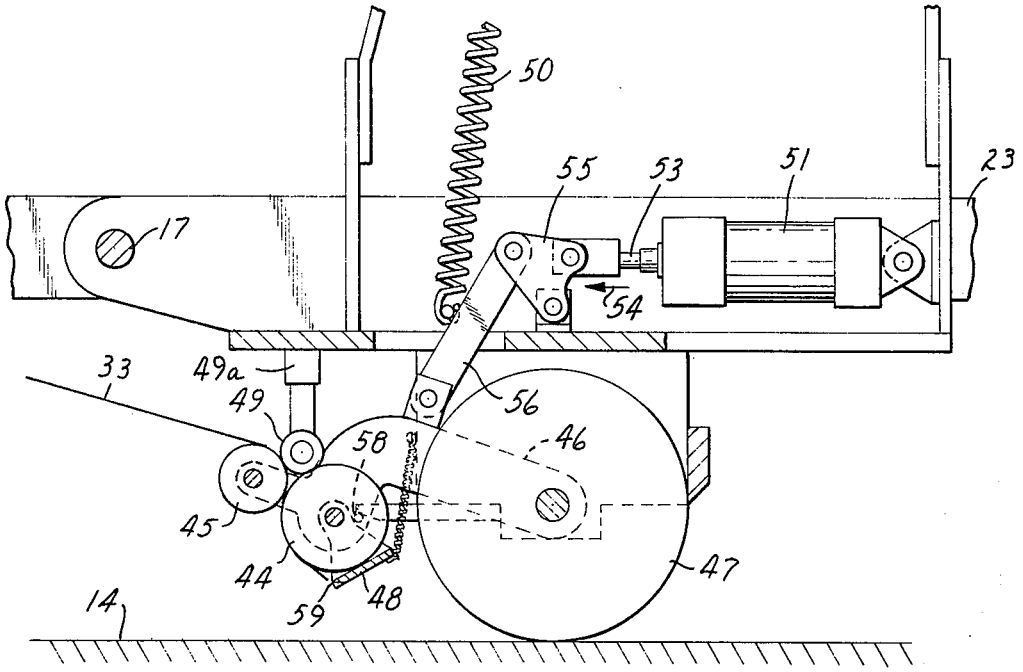
FIGS. 4 and 5 are side elevation views of a portion of the apparatus shown in FIG. 1.
Figure 5:
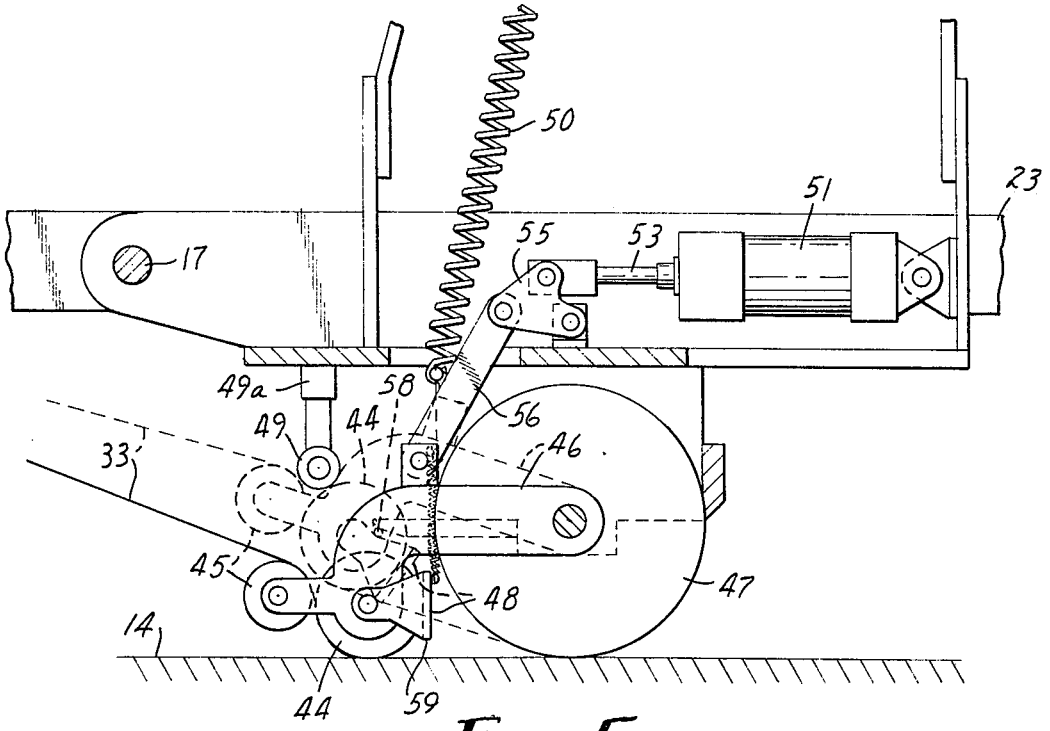

The application head 16 in the illustrative pavement-striping apparatus 10, as shown best in FIGS. 4 and 5, comprises an engagement roller 44 and a keeper roller 45 rotatably supported adjacent to one another on a lever arm 46; a pressure roller 47; and a cutting lever 48 pivotably mounted on the lever arm 46. FIG. 4 shows a position of the lever arm 46 immediately prior to initiation of a striping application. Tape 33 is threaded over the keeper roller 45 and under the engagement roller 44, and the lever arm 46 is held at rest against a stop 49 by a tension spring 50. The keeper roller 45 should rotate in one direction only, as through incorporation of a one-way clutch, to allow feeding of tape to the engagement roller while inhibiting movement of tape back toward the accumulator. Metal-foil-backed marking tapes are especially advantageous with structure as illustrated, since they hold a degree of curvature once they have been pulled under tension and around the engagement roller. However, other keeper structure, such as a channel-shaped guide, can be used to keep tape in position under the engagement roller.

Following initiation of a striping operation, by means that will be subsequently described, a pressurized cylinder 51 is actuated through a solenoid valve 52 to move piston rod 53 in the direction of the arrow 54. The rod is connected through a linkage 55 to an arm 56, and the dimensions of these parts are such that the lever arm 46 moves rapidly and forcefully to the position shown in solid lines in FIG. 5, thereby pressing the leading edge of the tape into engagement against the paved surface. The tape preferably carries a pressure-sensitive adhesive, or an adhesive may have been applied to the roadway by other means, so that the tape adheres to the roadway (rollers contacting the adhesive side of the tape are preferably knurled to reduce adhesion of the tape to the roller). The tape is then pressed upon by the pressure roller to more firmly adhere it to the roadway.

After a stripe of sufficient length has been applied, the solenoid valve 52 is operated to release pressure from the cylinder 51, whereupon the tension spring 50 retracts the lever arm 46 from the solid-line position in FIG. 5 to the dotted-line position. During upward movement of the lever arm, the cutting lever 48 contacts a stop 58 causing the cutting lever to pivot until its cutting edge 59 contacts and severs the length of tape extending between the pressure roller 47 and the engagement roller 44. To keep the lever arm 46 from springing back too rapidly, a flow-control valve is desirably included on the pressurized cylinder 51 to retard the release of pressure. Contact of the engagement roller 44 and keeper roller 45 with the stop 49 tends to brake rotation of those rollers so that tape is held tautly between the engagement roller and pressure roller 47 during the cutting operation. A shock absorber **49*a* is desirably included to cushion the impact of the engagement and keeper rollers with the stop 49.**

Immediately prior to application of tape in the manner described, the accumulator is in the dotted-line position shown in FIG. 1, held there by a tension spring 60. The biasing pressure applied by the spring 60 is partially countered by a pressurized cylinder 61 acting through piston rod 62. Together the pressurized cylinder 61 and spring 60 apply a biasing pressure which may be adjusted by adjusting the pressure in the cylinder. The cylinder 61 is two way, that is, it can be operated to apply pressure in the direction of either arrow 63 or arrow 64.

At the start of a striping operation, the cylinder 61 is operated through a solenoid valve 65 to apply pressure in the direction of the arrow 64, which slightly relaxes the biasing pressure on the accumulator bar 39. Desirably the biasing pressure at this time is such that finger pressure will rotate the accumulator bar 39 out of its dotted-line position in FIG. 1. In this mode of operation the cylinder 61 and spring 60 provide a tape-starting means; the relaxation of biasing pressure eases movement of tape when the engagement roller 44 is subsequently pressed into contact with the paved surface, at which time tension is suddenly and strongly applied on the tape. As application of tape continues, the combination of the force being applied on the tape as it is drawn out onto the paved surface and the inertia in the reel of tape causes the accumulator to move to the solid-line position in FIG. 1. To provide limits to the rotation of the accumulator bar, stops 76 and 77 are attached to portions of the frame 11.

At the end of a striping application and after the tape has been cut, continued rotation of the reel 31 to feed tape is compensated by rotation of the accumulator bar 39 into the position shown in dotted lines in FIG. 1, with the tape fed from the roll being accumulated in the accumulator. Also, a brake can be incorporated into the apparatus to assist in stopping rotation of the reel. One useful brake, as shown in FIG. 1, comprises a brake shoe 66 adapted to press against an outside axle 67 of the reel, a lever arm 68 pivotably attached at its midpoint to the arm 32 and at one end to the brake shoe 66, and attached at its other end to a cable 69 that extends to a point of attachment 70 on the accumulator bar. As the accumulator bar rotates to its dotted-line position in FIG. 1, increased pressure is applied by the brake shoe to gradually stop the reel 31.

Timing of the described operations of the illustrative pavement-striping apparatus 10 is controlled through use of electric circuitry as shown in FIG. 6. A time frame for the sequence of operations is established with a counter 72 connected to the pressure roller 47. Rotation of the pressure roller provides electric pulses to the counter 72, which are counted to provide a representation of the length of travel of the pavement-striping apparatus 10 along a paved surface. The initiation of operations is controlled through a control panel 73 by which timing of the initiation of striping, time between relaxation of biasing pressure and movement of engagement roller into contact with the paved surface, the length of stripe, and the spacing between intermittent stripes may be set. Following operation of an actuating button on the control panel 73, the pulses from the pressure roller are counted and compared in circuitry represented by 74 with the circuit parameters established at the control panel. At a given number of pulses, the solenoid 65 to the pressurized cylinder is operated to slightly relax the biasing pressure on the accumulator. Very shortly thereafter, typically within about 2 feet of travel of the apparatus 10, the solenoid 52 is actuated to press the engagement roller 44 into contact with the roadway. Thereupon, after sufficient pulses have been counted, the solenoid valves 52 and 65 are operated to release pressure in cylinders 51 and 61, and solenoid 75 is operated to restore pressure to the pressurized cylinder 61 and thereby return biasing pressure to its normal level prior to a striping operation.

Pressure can be applied to the pressurized cylinders through conduits from a source of pressure such as a bottle of compressed gas or a compressor operated on the striping apparatus or in the truck pulling the striping apparatus.

The abilities of the described apparatus are, insofar as known, unique in the pavement-striping industry. Apparatus of the invention can travel down a paved surface, and upon an electrically applied signal start applying a stripe. The stripe applied may be as long as "dialed in" at the control panel 73. The length, spacing, and starting point of the stripes may be changed while the apparatus is traveling on the roadway performing a striping operation, i.e. between application of stripes. This feature means that the stripes can be timed to coincide with old paint stripes and thus avoid confusing overlapping stripes.

As previously indicated, metal-foiled-based tapes can be applied with apparatus of the invention as can other types of pavement-marking tape, including paper-backed and plastic-backed tapes. The latter include the so-called "cold-plastic" tapes, which are deformable, reduced-elasticity tapes typically made from unvulcanized elastomers, such as acrylonitrile-butadiene polymers, and extender resins, such as chlorinated paraffins, hydrocarbon resins, or polystyrenes.

What is claimed is:

1. Apparatus for applying a pavement-marking tape to a paved surface comprising:

a. a frame;

b. a support on the frame for rotatably supporting a roll of said tape;

c. an application head on the frame for applying tape to the paved surface comprising:

i. an engagement roller that is movable to and away from the paved surface;

ii. keeper means for holding tape adjacent the engagement roller such that movement of the engagement roller to the paved surface presses the tape into engagement with the paved surface;

iii. a pressure roller for pressing the tape after it has been engaged against the paved surface by the engagement roller; and iv. cutter means for cutting tape that extends between the engagement roller and pressure roller after the engagement roller has been moved away from the paved surface;

the tape extending in a continuous length from the roll of tape to its position adjacent the engagement roller such that application of tape onto a paved surface by the engagement roller during movement of the apparatus along the paved surface applies a pulling force on the tape that results in unrolling of tape from the roll;

d. accumulator means located between the roll of tape and the application head and comprising a set of guides through which the tape is threaded, said guides being movable against an adjustable biasing pressure from a first position which provides a serpentine path for tape traveling from the roll of tape to the application head to at least a second position which provides a more direct path for the tape;

e. timer means for initiating movement of said engagement roller to and away from the paved surface; and f. tape-starting means actuatable by said timer means prior to movement of said engagement roller to the paved surface and comprising means for relaxing said biasing pressure so as to allow easier movement of said accumulator from its first position to its second position.

2. Apparatus of claim 1 in which said engagement roller is rotatably mounted on a lever arm and movement of the engagement roller into and out of contact with the paved surface is achieved by pivoting movement of the lever arm; and the keeper means comprises a roller capable of one direction of rotation mounted on said lever arm near to said engagement roller so as to define a path for tape between the engagement and keeper rollers.

3. Apparatus of claim 2 in which the cutter means comprises a lever that carries a cutting edge, and the lever is pivotably mounted on said lever arm and adapted to pivot during pivotal movement of the lever arm to present said cutting edge against tape extending from said engagement roller to said pressure roller.

4. Apparatus of claim 1 which includes a brake acting on said roll tape and increasing in braking force in proportion to greater movement of said accumulator guides from the second position to the first position.

5. Apparatus of claim 4 in which said brake is connected by a cable to mounting for said accumulator guides such that movement of said mounting mechanism to move said accumulator guides from the second position to the first position pulls the brake into tighter engagement with the reel.

6. Apparatus of claim 1 in which said biasing pressure comprises a spring and a pressurized cylinder acting on a piston to apply pressure countering said spring pressure, and the pressure in the pressurized cylinder is adjustable to adjust said biasing pressure.

7. Apparatus of claim 2 in which said lever arm is moved by a piston that is acted upon by a pressurized cylinder.

8. Apparatus for applying a pavement-marking tape to a paved surface comprising:

a. a frame;

b. a support on the frame for rotatably supporting a roll of said tape;

c. an application head for applying tape to the paved surface comprising:

i. an engagement roller that is movable to and away from the paved surface;

ii. keeper means for holding tape adjacent the engagement roller such that movement of the engagement roller to the paved surface presses the tape into engagement with the paved surface;

iii. a pressure roller for pressing the tape after it has been engaged against the paved surface by the engagement roller; and iv. cutter means for cutting tape that extends between the engagement roller and pressure roller after the engagement roller has been moved away from the paved surface;

the tape extending in a continuous length and under tension from the roll of tape to its position adjacent the engagement roller such that application of tape onto a paved surface by the engagement roller during movement of the apparatus along the paved surface applies a pulling force on the tape that results in unrolling of tape from the roll;

d. accumulator means located between the roll of tape and the application head and comprising a set of guides past which the tape is threaded, at least some of said guides being mounted on a pivotable bar which is movable from a first position which provides a serpentine path for tape traveling from the roll of tape to the application head to at least a second position which provides a more direct path for the tape;

e. biasing means for biasing said pivotable accumulator bar toward said first position comprising a tension spring and a pressurized cylinder operating in opposition to one another, the pressure in the cylinder being adjustable to either relax or increase the biasing pressure;

f. timer means for sequentially i. relaxing said biasing pressure;

ii. moving said engagement roller to the paved surface; and iii. simultaneously, or in either order, moving said engagement roller away from the paved surface and restoring said biasing pressure.

9. Apparatus of claim 8 which includes a braking action on said roll of tape and which increases in braking force in proportion to greater movement of said accumulator guides from the second position to the first position.

10. Apparatus of claim 8 in which said application head further includes a stop against which the engagement roller is pressed upon movement away from the paved surface, and that pressure applies a braking action on the engagement roller.

11. Apparatus for applying a pavement-marking tape to a paved surface comprising:

a. a frame;

b. a support on the frame for rotatably supporting a roll of said tape;

c. an engagement means for pressing the leading edge of the tape into engagement with the paved surface; the tape extending in a continuous length from the roll of tape to the engagement means such that application of tape onto a paved surface by the engagement means during movement of the apparatus along the paved surface applies a pulling force on the tape that results in unrolling tape from the roll;

d. cutter means for cutting tape at a point beyond said engagement means on the path from the roll of tape to the paved surface;

e. accumulator means located between the roll of tape and the engagement means and comprising a set of guides through which the tape is threaded, at least some of said guides being movable against an adjustable biasing pressure from a first position which provides a serpentine path for tape traveling from the roll of tape to the application head to at least a second position which provides a more direct path for the tape;

f. timer means for initiating movement of said engagement means to press tape onto the paved surface; and g. tape-starting means actuatable by said timer means prior to movement of said engagement means to the paved surface and comprising means for relaxing said biasing pressure so as to allow easier movement of said accumulator from its first position to its second position.

12. Apparatus of claim 11 in which said timer means is adjustable to adjust the timing of actions controlled by the timing means.

* * * * *